US012338557B2

(12) United States Patent
Xiong et al.

(10) Patent No.: US 12,338,557 B2
(45) Date of Patent: Jun. 24, 2025

(54) WOVEN MESH STRUCTURE

(71) Applicant: ASIA VITAL COMPONENTS (CHINA) CO., LTD., Shenzhen (CN)

(72) Inventors: Xiwen Xiong, Shenzhen (CN); Jiafu Dai, Shenzhen (CN)

(73) Assignee: ASIA VITAL COMPONENTS (CHINA) CO. , LTD., Shenzhen (CN)

( * ) Notice: Subject to any disclaimer, the term of this patent is extended or adjusted under 35 U.S.C. 154(b) by 0 days.

(21) Appl. No.: 18/518,516

(22) Filed: Nov. 23, 2023

(65) Prior Publication Data

US 2025/0171934 A1 May 29, 2025

(51) Int. Cl.

| | |
|---|---|
| ***D03D 15/00*** | (2021.01) |
| ***D03D 15/25*** | (2021.01) |
| ***D03D 25/00*** | (2006.01) |
| *D03D 1/00* | (2006.01) |

(52) U.S. Cl.
CPC ..... *D03D 25/00* (2013.01); *D03D 15/25* (2021.01)

(58) Field of Classification Search
CPC ..... D03D 25/00; D03D 15/25
See application file for complete search history.

(56) References Cited

U.S. PATENT DOCUMENTS 4,476,206 A * 10/1984 Viala ..... H01M 4/74 429/234
5,824,004 A * 10/1998 Osborn, III ..... A61F 13/47218 604/389
7,220,334 B2 * 5/2007 Anazawa ..... B01J 19/0093 422/537
11,781,816 B2 * 10/2023 Mao ..... F28D 15/0275 165/104.26
12,022,871 B2 * 7/2024 Kalaydzhyan ..... H05B 3/265
2003/0175162 A1 * 9/2003 Anazawa ..... B01L 3/502707 422/537
2010/0254090 A1 * 10/2010 Trautman ..... H05K 7/20336 29/890.032

(Continued)

FOREIGN PATENT DOCUMENTS

CN 104776742 A 7/2015
CN 217818301 U 11/2022

(Continued)

OTHER PUBLICATIONS

Search Report dated Apr. 23, 2024 issued by Taiwan Intellectual Property Office for counterpart application No. 112143073.

*Primary Examiner* — Robert H Muromoto, Jr.
(74) *Attorney, Agent, or Firm* — Demian K. Jackson; Jackson IPG PLLC

(57) ABSTRACT

A woven mesh structure includes a plurality of first threads extending in a longitudinal direction and a plurality of second threads extending in a transverse direction. The first and the second threads are interwoven to form the woven mesh structure, which can be cut to size, so that each piece of the cut-to-size woven mesh structure has clipped edges formed around it. Each of the clipped edges is non-parallel with the first and the second threads, so that an inclined angle is formed on each of the first and the second threads at their intersections with the clipped edge. This arrangement may prevent the first and the second threads located adjacent to the clipped edge from loosening and separating from the woven mesh structure.

5 Claims, 2 Drawing Sheets

(56) References Cited

U.S. PATENT DOCUMENTS

| | | | | |
|---|---|---|---|---|
| 2021/0199385 | A1* | 7/2021 | Guo | F28D 15/043 |
| 2021/0199386 | A1* | 7/2021 | Zhang | H01L 23/427 |
| 2024/0277952 | A1* | 8/2024 | Fursa | A24F 40/40 |

FOREIGN PATENT DOCUMENTS

| | | | |
|---|---|---|---|
| TW | 201028636 | A1 | 8/2010 |
| TW | M651306 | | 2/2024 |

* cited by examiner

WOVEN MESH STRUCTURE

FIELD OF THE INVENTION

The present invention relates to a woven mesh, and more particularly, to a woven mesh structure that can be cut to size to have clipped edges that prevent warps and wefts of the woven mesh structure from easily loosening and separating from the woven mesh structure.

BACKGROUND OF THE INVENTION

Following the quick development in the technological industry, most of the currently available 3C electronic products are configured to be light in weight and compact in volume. Meanwhile, all the heat dissipation units mounted in the compact 3D products for heat dissipation and heat transfer must also be reduced in dimensions. For this reason, devices such as heat pipe or vapor chamber that utilize the principle of two-phase flow have received wide attention. The heat transfer performance of the two-phase flow devices is largely relied on the wick structures provided therein.

The wick structure most frequently used in the heat pipe and the vapor chamber is sintered powder, which provides relatively good capillary force but could not be used as a wick structure in some conditions, e.g. in a very thin device or in a device that is to be bent or folded repeatedly in use. In this case, fibrous structure or woven mesh structure is used to replace the sintered powder.

Conventionally, the wick structure in the form of woven mesh includes a plurality of metal or nonmetal wires that extend either in a longitudinal or in a transverse direction and are interwoven. To match actual dimensions or shape in the heat pipe or the vapor chamber, the woven mesh must be cut, stamped, sliced, etc. in the production process, so that the produced woven mesh in the form of a large-area sheet or a woven mesh in roll is cut to match required shape and size. When using a cut tool or a cut die to cut the woven mesh, the cut tool or the cut die is positioned parallel with warps 82 or wefts 84 of the woven mesh, and clipped edges formed on the cut-to-size/shape woven mesh are also parallel with the warps 82 and the wefts 84. In this case, the warps 82 and the wefts 84 that are located closely adjacent the clipped edges tend to easily become loosened and separated from the clipped edges, as shown in FIG. 3, because the clipped edges parallel with the warps and wefts have no binding force to the latter. The woven mesh with incomplete edges and having loosened threads (or the wires) along the clipped edges could not be fully and smoothly fitted on the inner wall surfaces of the vapor chamber or the heat pipe because the loosened threads would possibly cause warpage of the woven mesh. The warped woven mesh loses its capillary action and could not help a liquid-phase working fluid to flow back to a vaporizing zone in the vapor chamber or the heat pipe. The working fluid tends to accumulate and possibly becomes frozen at the edges with the loosened threads, which will cause expansion of the vapor chamber or heat pipe or cause dry burning in the vaporizing zone of the vapor chamber or the heat pipe.

The loosened threads at the edges of the woven mesh would also possibly cause the vapor chamber to lose its airtightness and accordingly, cause leakage of the working fluid from the vapor chamber.

It is therefore desirable to overcome the disadvantage and problem in the conventional woven mesh structure.

SUMMARY OF THE INVENTION

To effectively solve the above problem, it is a primary object of the present invention to provide a woven mesh structure having a plurality of first and second threads extending in two different weaving directions. The woven mesh structure can be cut to size to have clipped edges. Each of the clipped edge is a curved or a jagged cutting line not parallel with the first and the second threads. Therefore, an inclined angle is formed on each of the first and second threads at their intersections with the clipped edges, preventing the threads located adjacent to the clipped edges from easily loosening and separating from the woven mesh structure.

Another object of the present invention is to provide a woven mesh structure having edges that prevent threads of the woven mesh from easily separating from the woven mesh structure.

To achieve the above and other objects, the woven mesh structure of the present invention includes a plurality of first and second threads, the first and the second threads extending in two different directions are interwoven to form a large-area woven mesh structure; the woven mesh structure can be cut to size and shape, such that each piece of the cut-to-size/shape woven mesh structure has a smaller area and has at least one clipped edge. The clipped edge can be a linear or a non-linear curved line, or a continuous irregular line, such that an inclined angle is formed on the first and the second threads at their intersections with the curved clipped edge. The clipped edge is nonparallel with the first and the second threads to well prevent the first and the second threads located adjacent to the clipped edge from easily loosening and separating from remaining threads.

The woven mesh structure of the present invention may be used as a wick structure in a two-phase flow device. Since each piece of the cut-to-size/shape woven mesh structure has clipped edges that are linear or non-linear curves or continuous irregular lines relative to the first and second threads, the clipped edges are not parallel with the first and the second threads and an inclined angle is formed on each of the first and second threads at their intersections with the clipped edges. As such, the first and second threads located adjacent to the clipped edges are not subjected to loosening and separating from remaining threads on the cut-to-size woven mesh structure.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

The present invention will now be described with a preferred embodiment thereof. It is understood the accompanying drawings are only illustrative to facilitate easy description of the present invention and not intended to limit the scope of the present invention in any way.

Figure 2:
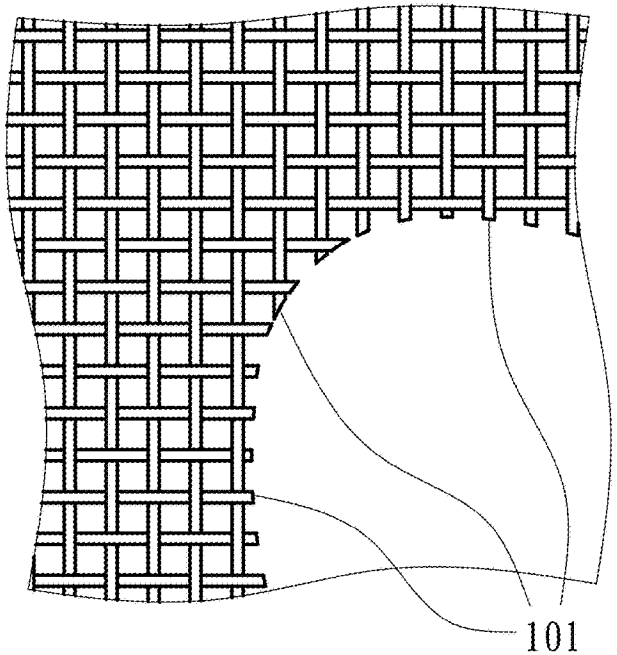
FIG. 2 shows the woven mesh structure of FIG. 1 after it is cut along a curved line.
Figure 1:
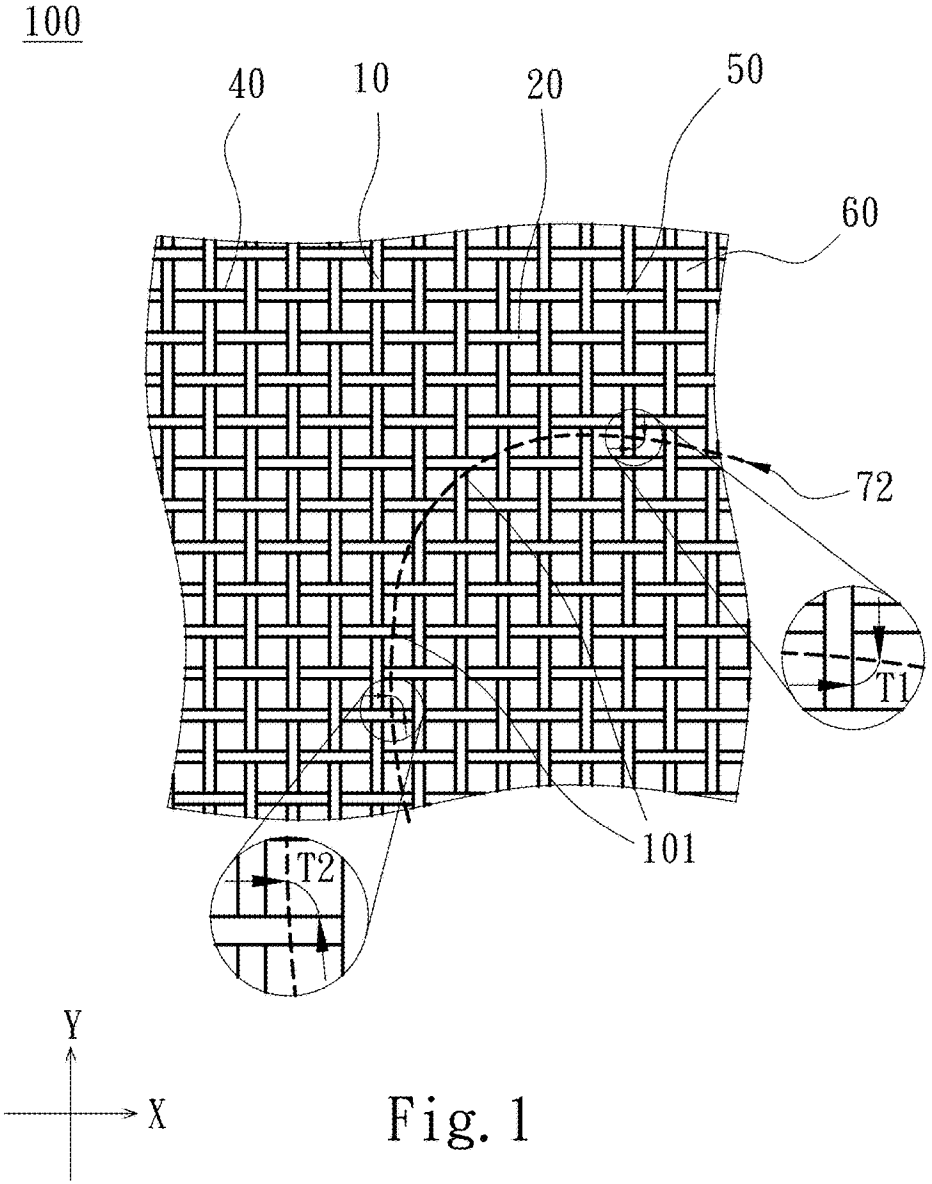
FIG. 1 is a fragmentary view of a woven mesh structure of the present invention before it is cut along a curved line.

Please refer to FIGS. 1 and 2. As shown, the present invention provides a woven mesh structure 100, which includes a plurality of first threads 10 and a plurality of second threads 20.

In the preferred embodiment, the first threads 10 are illustrated as warps and the second threads are illustrated as wefts. However, the present invention is not limited to the above arrangements in any way. The first threads 10 extend in a first weaving direction Y (or a longitudinal direction), and the second threads 20 extend in a second weaving direction X (or a transverse direction), such that the first and the second threads 10, 20 are woven in two different weaving directions to sequentially and repeatedly cross and interlace with each other as in the so-called plain weave to produce the woven mesh structure 100 of the present invention having a criss-cross pattern.

The produced woven mesh structure 100 has a plurality of frame portions 40, a plurality of overlapped portions 50, and a plurality of mesh openings 60 formed thereon. In the preferred embodiment, each of the frame portions 40 means a frame formed on the woven mesh structure 100 by two adjacent first threads 10 and two adjacent second threads 20 that are interlaced with one another. Each of the overlapped portions 50 means a location on the woven mesh structure 100, at where one first thread 10 extending longitudinally meets and crosses one second thread 20 extending transversely. More specifically, each overlapped portion 50 is formed by a first part and a second part that face toward and cross with each other. Each mesh opening 60 is enclosed in one frame portion 40 with four overlapped portions 50 located at four corners of the frame portion 40.

The woven mesh structure 100 of the present invention produced in a plant before delivery is in the form of a large-area woven mesh. To meet the actual internal size or shape in a two-phase flow device, such as a heat pipe or a vapor chamber, the large-area woven mesh is processed by cutting it into pieces having required size or shape. More specifically, the cut-to-size woven mesh structure 100 includes a plurality of clipped edges 101 along its outer side. The clipped edges 101 forms a continuous cutting line along the outer side of the woven mesh structure 100 corresponding to each of the first threads 10 and each of the second threads 20. The cutting line may be a linear or a non-linear curve 72, as the continuous curve shown in FIGS. 1 and 2. Alternatively, the cutting line may be a continuous irregular line. And, the clipped edges 101 extend in directions that are not parallel with the first weaving direction Y and the second weaving direction X. That is, each of the clipped edges 101 is not parallel with the first threads 10 and the second threads 20, such that an inclined angle (or included angle) is formed on each of the first threads 10 and each of the second threads 20 at their intersections with the clipped edge 101. As shown in FIGS. 1 and 2, an inclined angle (or included angle) T1 is formed between each clipped edge 101 and one first thread 10, and another inclined angle (or included angle) T2 is formed between each clipped edge 101 and one second thread 20. With these arrangements, the ends of the first threads 10 and the second threads 20 located at the clipped edges 101 would not become loosely separated from the woven mesh structure 100, which would otherwise occur in the case the cutting line is parallel with the warps or the wefts.

The woven mesh structure 100 has been cut to size may have a regular or an irregular shape. When the woven mesh structure 100 of the present invention is used in a two-phase flow device, such as a vapor chamber or a heat, since the clipped edge 101 of the cut-to-size woven mesh structure 100 won't become loosely separated from other first and second threads 10, 20, the cut-to-size woven mesh structure 100 can fully fitly attached to chamber inner wall surfaces of the vapor chamber or pipe inner wall surfaces of the heat pipe to provide good capillary action, helping a liquid-phase working fluid in the vapor chamber or the heat pipe to smoothly and thoroughly flow back to a vaporizing zone in the vapor chamber or the heat pipe.

Figure 3:
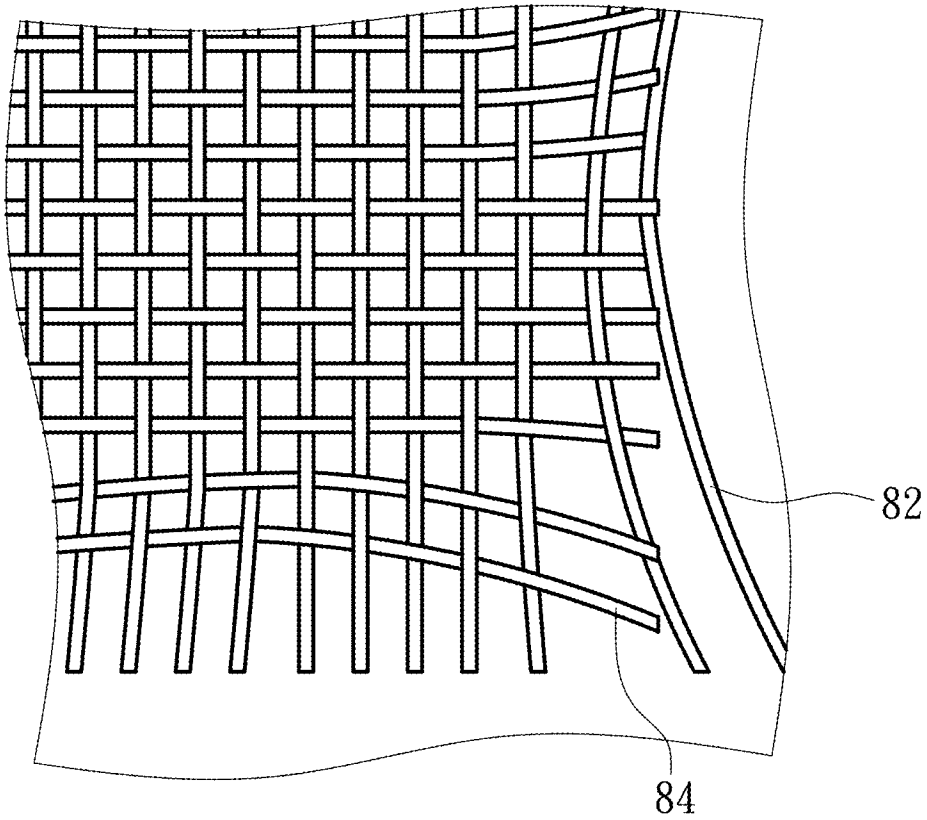
(PRIOR ART) Fig. 3
FIG. 3 is a fragmentary view of a conventional woven mesh structure, wherein wefts and warps of the woven mesh structure located at cut edges thereof become loosened.

In brief, each of the clipped edges 101 on the cut-to-size woven mesh structure 100 is formed as a linear or a non-linear curve 72 or as a continuous irregular line, for example, a jagged line. Where the clipped edge intersects with either the first or the second threads 10, 20 would have an inclined angle formed thereat, such that the clipped edge 101 is always not parallel with the first and the second threads 10, 20. With this arrangement, any of the first and the second threads 10, 20 located at the clipped edges 101 would not become loosely separated from other portions of the cut-to-size woven mesh structure 100 that are located farther away from the clipped edges 101, and it is able to effectively improve the problem in the conventional woven mesh that the large-size mesh is clipped in directions parallel with the warps and the wefts to provide small-size meshes, which leads the outer threads of the cut meshes located near the clipped edges to easily loosen and separate from the inner threads, as shown in FIG. 3.

The present invention has been described with a preferred embodiment thereof and it is understood that many changes and modifications in the described embodiment can be carried out without departing from the scope and the spirit of the invention that is intended to be limited only by the appended claims.

What is claimed is:

1. A woven mesh structure comprising a plurality of first threads extending in a first weaving direction and a plurality of second threads extending in a different, second weaving direction, the first and the second threads being interwoven to form the woven mesh structure; the woven mesh structure being cut to size, such that each piece of the cut-to-size woven mesh structure has at least one clipped edge; the clipped edge describing a curved line, such that an included angle is formed at cut ends of all first and second threads which intersect with the curved clipped edge, such that the clipped edge is nonparallel with each cut end of the first and the second threads.

2. The woven mesh structure as claimed in claim 1, wherein the first and second threads are interlaced with one another to form a plurality of overlapped portions, each of which includes a first and a second part; and the first part and the second part facing toward and crossing with each other.

3. The woven mesh structure as claimed in claim 1, wherein the first and the second threads are made of a material selected from the group consisting of a copper material and any one of other metal materials.

4. The woven mesh structure as claimed in claim 1, wherein the clipped edge can be one of a linear curve and a non-linear curve.

5. The woven mesh structure as claimed in claim 4, wherein the curve is a jagged curve.

* * * * *